US005188455A

United States Patent [19]

Hammerstedt

[11] Patent Number: 5,188,455

[45] Date of Patent: Feb. 23, 1993

[54] APPARATUS FOR REMOTE MIXING OF FLUIDS

[75] Inventor: Roy H. Hammerstedt, Boalsburg, Pa.

[73] Assignee: The Pennsylvania Research Corporation, University Park, Pa.

[21] Appl. No.: 612,644

[22] Filed: Nov. 13, 1990

[51] Int. Cl.[5] ..... B01F 15/02

[52] U.S. Cl. ..... 366/150; 137/896; 137/897; 222/207; 222/214; 222/145; 222/135; 222/336

[58] Field of Search ..... 366/336, 337, 339, 340, 366/150; 251/7; 137/896, 897; 417/474, 478; 406/80, 82, 83, 67, 181, 196, 73, 76, 85; 222/207, 214, 145, 135, 336; 92/92

[56] References Cited

U.S. PATENT DOCUMENTS

| | | | |
|---|---|---|---|
| 2,890,868 | 6/1959 | Potchen | 366/336 |
| 2,975,553 | 3/1961 | Paul | 47/1 |
| 2,988,321 | 6/1961 | Gilmont | 251/214 |
| 3,134,650 | 5/1964 | Tanner et al. | 23/267 |
| 3,496,970 | 2/1970 | Pontigny | 141/105 |
| 3,543,791 | 12/1970 | Fox | 366/340 |
| 3,769,176 | 10/1973 | Hise et al. | 195/142 |
| 3,800,984 | 4/1974 | Phelan | 23/259 |
| 3,924,989 | 12/1975 | Althausen | 366/336 |
| 4,161,264 | 7/1979 | Malmgren et al. | 222/135 |
| 4,176,671 | 12/1979 | Citrin | 251/7 |
| 4,208,483 | 6/1980 | Lee | 435/284 |
| 4,261,356 | 4/1981 | Turner et al. | 222/207 |
| 4,350,429 | 9/1982 | Slavin | 354/299 |
| 4,366,839 | 1/1983 | Slavin | 137/625.11 |
| 4,399,102 | 8/1983 | Karlberg et al. | 422/82 |
| 4,446,344 | 5/1984 | Fiedler | 92/92 |
| 4,501,405 | 2/1985 | Usry | 251/7 |
| 4,512,764 | 4/1985 | Wunsch | 604/83 |
| 4,563,336 | 1/1986 | McKnight | 422/240 |
| 4,566,480 | 1/1986 | Parham | 137/271 |
| 4,576,159 | 3/1986 | Hahn et al. | 137/896 |
| 4,586,691 | 5/1986 | Kozlow | 251/7 |
| 4,595,565 | 6/1986 | Tenhagen | 137/896 |
| 4,657,490 | 4/1987 | Abbott | 417/478 |
| 4,676,274 | 6/1987 | Brown | 137/806 |
| 4,680,266 | 7/1987 | Tschopp et al. | 435/284 |
| 4,783,413 | 11/1988 | Suter | 435/284 |
| 4,857,048 | 8/1989 | Simons et al. | 604/67 |
| 4,873,057 | 10/1989 | Robertson et al. | 422/75 |
| 4,908,187 | 3/1990 | Holmquist et al. | 422/81 |
| 4,909,933 | 3/1990 | Carter et al. | 210/95 |
| 4,952,068 | 8/1990 | Flint | 366/340 |
| 4,993,456 | 2/1991 | Sule | 251/7 |
| 5,035,350 | 7/1991 | Blette | 222/214 |

*Primary Examiner*—Harvey C. Hornsby
*Assistant Examiner*—Tony Soohoo
*Attorney, Agent, or Firm*—Thomas J. Monahan

[57] ABSTRACT

An apparatus for mixing fluids is described which includes a flexible tubular member disposed between opposed ends. Filling and clamp systems are placed adjacent each of the opposed ends, creating sealed chambers in the tubular member, each chamber including a reagent fluid. The sealed reagent chambers are separated by a mixing chamber, and all of the chambers are disposed within the tubular member. A spring driven plate pressurizes each of the reagent chambers. A control system is coupled to each of the clamp systems for selectively opening a channel between at least one reagent chamber and the mixing chamber, with reagent in a reagent chamber being forced, via the open channel, into the mixing chamber by the spring biased pressurizing plate.

12 Claims, 2 Drawing Sheets

APPARATUS FOR REMOTE MIXING OF FLUIDS

FIELD OF THE INVENTION

This invention relates to a device for selectively mixing fluids, and in particular, to an apparatus for remote mixing of reactant fluids.

BACKGROUND OF THE INVENTION

Most biologic experiments, of necessity, have been heretofore conducted with gravity as a constant, and thus, the relationships between gravity and fundamental cellular mechanisms are unknown. Use of the space microgravity environment, graded levels of gravity by centrifugation in space, and the unit gravity control situation on earth can provide a unique method for evaluating the interrelation of all structures and functions.

Microgravity experiments require a means to add stimulants (e.g., hormones) to cells at various times, followed by a means to either: (a) observe and record the cellular response or (b) add chemicals to preserve cellular structure and features (fixation) for later detailed analysis.

Common methods of fluid addition (e.g., syringes, pumps, moving valves, etc.), require significant power for operation, are often large and fragile and sometimes require secondary mixing to assure dispersion. These features severely reduce the number of duplicate units that can be used in a single space mission. The prior art contains a number of examples of such mixing systems. In Carter et al. U.S. Pat. No. 4,909,933, a multi aperture mixing system is described which employs a rotatable valve that enables the contents of either two or three interconnected chambers to be intermixed in a low gravity environment. In Hise et al. U.S. Pat. No. 3,769,176, a dialysis system employs gas pressurized pump chambers to provide remote feeds for reactants.

The prior art contains a variety of systems for moving a fluid from one chamber to another chamber for the purpose of carrying out a reaction. In Tschopp and Suiter U.S. Pat. No(s). 4,680,266 and 4,783,413, respectively, osmotic pumps are employed wherein the migration of one fluid through a permeable membrane into the interior of the pump chamber, causes an increase in pressure therein which in turn forces out a reactant fluid. In Lee U.S. Pat. No. 4,208,483, a cylindrical bottle filled with a culture medium has a rotatable shaft therein with treated disks that are mounted at an angle to the shaft and are rotatable therewith. The reactant fluid is pumped along the length of the chamber by the rotation action of both the shaft and the disks. In Tanner et al. U.S. Pat. No. 3,134,650, air-pulse operated liquid mixing systems are disclosed. Many patents show the use of reciprocal pump-driven reactant mixing systems and these include Pontigny U.S. Pat. No. 3,496,970, Phelan U.S. Pat. No. 3,800,984, and Slaven U.S. Pat. No(s). 4,350,429 and 4,366,839.

The prior art also discloses a number of reaction chamber structures for carrying out various biochemical reactions. Such systems are shown in Paul U.S. Pat. No. 2,975,553, Miltonburger et al. U.S. Pat. No. 4,649,114, Robertson et al. U.S. Pat. No. 4,873,057, and Holmquist et al. U.S. Pat. No. 4,908,187. Further details of such systems, such as fluid flow control devices, flow control capillary systems, reaction chamber assemblies etc. are shown in Gilmont U.S. Pat. No. 2,988,321, Brown U.S. Pat. No. 4,676,274, Karlberg et al. U.S. Pat. No. 4,399,102, McKnight U.S. Pat. No. 4,563,336, and Parham U.S. Pat. No. 4,566,480.

A common feature of substantially all of the system and subcomponent prior art references described above is their requirement for powered pumping systems, their requirement for relatively precisely machined parts and, in many instances, a significant level of complexity.

Accordingly, it is an object of this invention to provide a system for mixing of reactant fluids which is both simple of construction and inexpensive.

It is another object of this invention to provide a system for remote mixing of fluids wherein power requirements are minimized.

A further object of this invention is to provide a system for remote mixing of fluids in a microgravity environment.

SUMMARY OF THE INVENTION

An apparatus for mixing fluids is described which includes a flexible tubular member disposed between opposed ends. Filling and clamp systems are placed adjacent each of the opposed ends, creating sealed chambers in the tubular member, each chamber including a reagent fluid. The sealed reagent chambers are separated by a mixing chamber, and all of the chambers are disposed within the tubular member. A spring driven plate pressurizes each of the reagent chambers. A control system is coupled to each of the clamp systems for selectively opening a channel between at least one reagent chamber and the mixing chamber, with reagent in a reagent chamber being forced, via the open channel, into the mixing chamber by the spring biased pressurizing plate.

DETAILED DESCRIPTION OF THE INVENTION

Figure 1:
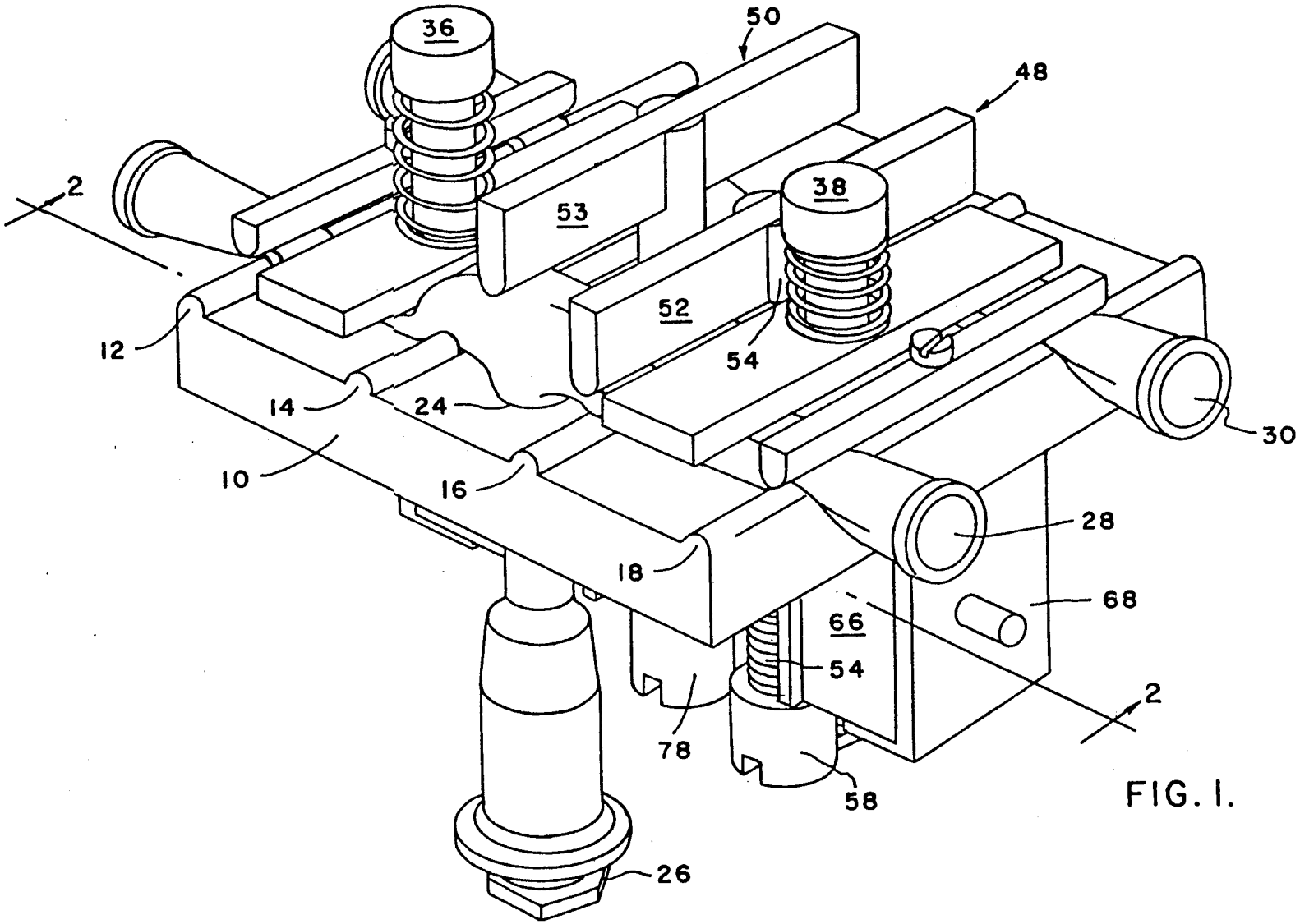
FIG. 1 is a perspective view of a fluid mixing system incorporating the invention hereof.
Figure 2:
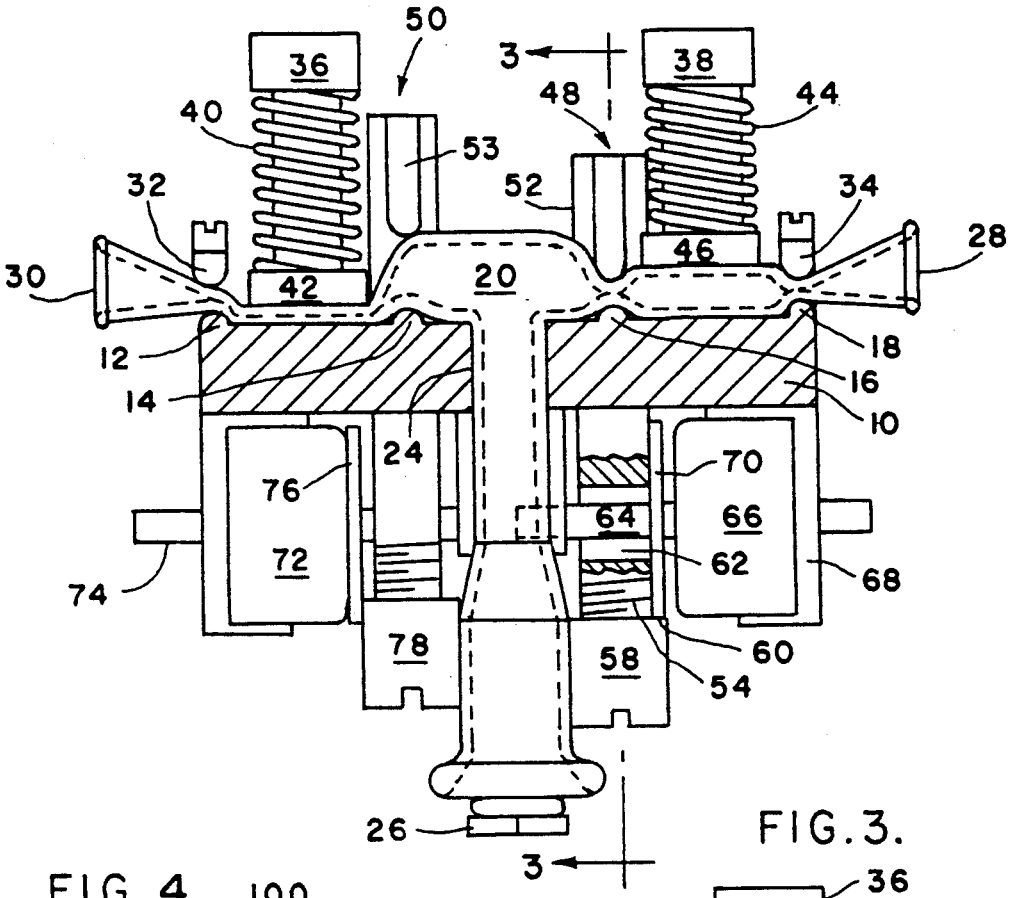
FIG. 2 is an end view, taken along line 2—2, of the system shown in FIG. 1.
Figure 3:
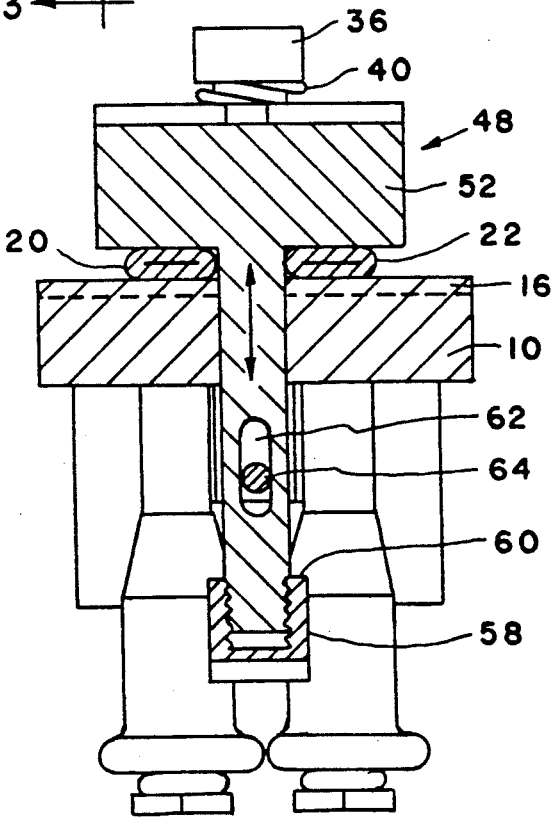
FIG. 3 is a sectional view, taken along line 3—3, of the end view of FIG. 2.

Referring now to FIGS. 1-3, a base plate 10 has formed thereon a plurality of ridges 12, 14, 16, and 18. A pair of T-shaped, flexible, tubular members 20 and 22 are positioned so that the cross bar portion of each T rests upon baseplate 10 and ridges 12, 14, 16, and 18.

The vertical portion of each T extends downwardly through an orifice 24 in baseplate 10. This can be visualized by referring to FIG. 2 wherein flexible, tubular members 20 is shown passing through orifice 24 in baseplate 10.

The bottom of each vertical portion of each tubular member 20, 22 is sealed by a stopper assembly 26. At each extremity of the crossbar of tubular members 20, 22, there are openings 28 and 30 that provide communication with the interior of tubular members 20, 22. A pair of sidestraps 32 and 34 are held in place by machine screws, with each sidestrap acting as a pinch-closure to seal the internal hollow areas of the crossbars of tubular member 20, 22.

A pair of head bolts 36 and 38 are tapped into baseplate 10. Head bolt 36 holds a helical spring 40 which biases a pressure plate 42 against the outer surfaces of the leftmost crossbar sections of tubular members 20, 22. Head bolt 38 also holds a helical spring 44 and pressure plate 46, and acts similarly against the rightmost crossbar sections of tubular members 20 22.

A pair of yoke bar assemblies 48 and 50 are positioned interiorly of head bolts 36 and 38 and provide a further pinching action to create reactant holding chambers within the crossbars of tubular members 20 and 22. Yoke assembly 48 includes a yoke bar 52 rigidly attached to a yoke bar shaft 54 which is, in turn, slidably mounted in a through-hole 56 in baseplate 10 (see FIG. 3). The lowermost extremity of yoke bar shaft 54 has a cap 58 threaded thereon. Cap 58 is used to adjust the effective length of yoke bar shaft 54. The upper edge 60 of cap 58 provides a bearing or latch surface that holds yoke assembly 48 in a downward pinching position (to be hereinafter described).

An oval shaped opening 62 is formed in yoke bar shaft 54 and provides for the passage of a solenoid core 64 therethrough. A solenoid body 66 is attached to the underside of baseplate 10 via a clamp 68 (see FIGS. 1 and 2). Solenoid core 64 has attached thereto an orthogonally disposed plate 70 that moves in conjunction with core 64 when it is operated by solenoid body 66.

When yoke bar assembly 48 is pushed downwardly so that yoke bar 52 pinches tubular members 20 and 22 against rib 16, cap 58 is also pushed down to a point where the lower edge of plate 70 rides over edge 60 of cap 58 and thus locks yoke bar assembly 48 into a lowermost position. In this position yoke bar 52 completely seals closed tubular members 20 and 22.

When solenoid body 66 is energized, it draws solenoid core 64 to the right, along with bar 70. As soon as the lowermost portion of bar 70 clears edge 60, yoke bar assembly 48 is free to ride upward and thereby releases its pinching effect on tubular members 20 and 22. Yoke bar assembly 50, along with solenoid 70 and solenoid core 72 operate identically to that described with respect to yoke bar assembly 48.

The operation of the system shown in FIGS. 1–3 will now be described. Prior to placing any reactant fluids in tubular members 20 and 22, shoulder head bolts 36 and 38 are loosened so that plates 42 and 46 do not bear down on the crossbar sections of tubular members 20 and 22. In addition, sidestraps 32 and 34 are released so that tubular members 20 and 22 can be filled with reactant fluids. Next, both yoke bar assemblies 48 and 50 are pressed downwardly (by hand pressure) until bars 70 and 76 engage with the uppermost surfaces of caps 58 and 78. This action causes yokebars 52 and 53 to pinch tubular members 20 and 22 against ridges 16 and 14, respectively. As a result, a plurality of chambers are created which will hereinafter be referred to as the leftmost, rightmost and central, chambers. At this point, reactant fluids are placed in the rightmost chambers of tubular members 20, 22 and side strap 34 is tightened down to seal the fluids within the chambers.

Similarly, reactant fluids are next placed into the leftmost chambers of tubular members 20, 22 and strap 32 is tightened down to seal the fluids therein. Next, the lower plugs, e.g., plug 26, are removed and still other reactant fluids are placed in the central chambers and the plugs are replaced. Head bolts 36 and 38 are then somewhat tightened so that plates 42 and 46 bear down upon the leftmost and rightmost fluid containing chambers respectively. This action causes the chambers to be pressurized, however, since extremities of these chambers are pinched shut, no fluid escapes therefrom.

When it is subsequently desired to mix the reactant fluids, one or the other of solenoid bodies 66 and/or 72 is energized. Assuming that the fluids in the rightmost chambers are to be introduced into the central chambers, solenoid body 66 is energized and causes core 64 and attached plate 70 to move to the right. This action releases yoke bar assembly 48 for upward movement. When this occurs, plate 46 is moved downwardly by spring 44 and causes the fluids within rightmost chambers to be forced into the central chambers and mixed with any fluids which are present therein. (In FIGS. 1 and 2, such action has already occurred in the leftmost chambers, as can be seen from the lowered position of plate 42). As is obvious, either one, or the other, or both simultaneously of solenoids 66 and 72 can be operated, thereby providing considerable flexibility in the sequence of reactions which occur in the respective fluid-containing chambers.

While only two flexible tubular members 20 and 22 are shown, the structure shown in FIGS. 1–3 can be extended in the lateral direction with as many reaction chambers being provided as desired. For each pair of additional tubular members, it is preferred that the control system, yoke assemblies, solenoids, etc. be replicated. It is preferred that tubular members 20 and 22 be comprised of a flexible, non-reactive, silicone rubber or other type of flexible material exhibiting similar characteristics.

Figure 4:
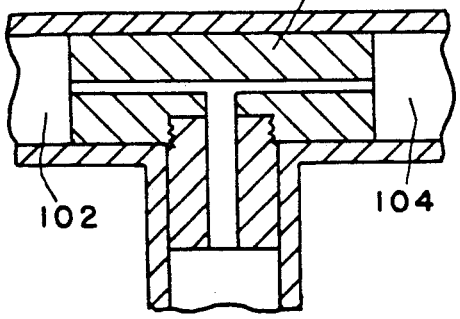
FIGS. 4 and 5 show modifications to the tubular member shown in FIGS. 1 and 2.
Figure 5:
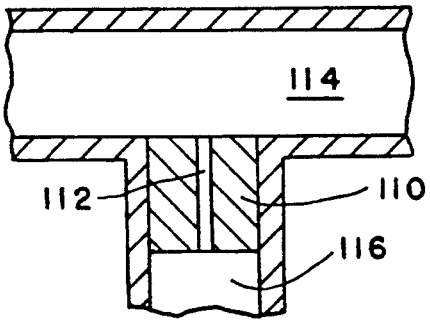

Referring now to FIGS. 4 and 5, modifications are shown to the structure of a tubular member which provide for different reactant mixing modes. In FIG. 4, the tubular member is provided with an insert member 100 that creates turbulent fluid flow from right and left reactant chambers 102, 104 into central chamber 106. In FIG. 5, insert 110 has a small orifice 112 which effectively separates the central chamber into two reaction chambers, i.e., upper chamber 114 and lower chamber 116. This structure allows rapid fill and mixing in upper chamber 114, followed by diffusion through orifice 112 into lower chamber 116. It is to be understood that insert members 100 and 110 may be either molded in place when the tubular member is molded or added subsequently.

It should be understood that the foregoing description is only illustrative of the invention. Various alternatives and modifications can be devised by those skilled in the art without departing from the invention. For instance, while one application of the invention is in microgravity environments, it is equally usable for any remote non-hands-on fluid mixing applications. Accordingly, the present invention is intended to embrace all such alternatives, modifications and variances which fall within the scope of the appended claims.

I claim:

1. An apparatus for mixing fluids comprising:

a flexible, tubular member having opposed closed ends;

a clamp means positioned adjacent each said opposed closed end for creating a sealed chamber adjacent each said opposed, closed end of said tubular member, each chamber containing a reagent fluid, said chambers separated by a central mixing chamber;

spring biased means bearing upon said sealed chambers to continually pressurized reagents therein; and control means coupled to each said clamp means for selectively enabling movement of a clamp means to open a channel between a reagent containing chamber and said central mixing chamber, whereby reagent in a said reagent containing chamber positioned adjacent the enabled clamp means, is forced through said channel into said central mixing chamber by a one-time movement of said spring biased means, operation of all said clamp means enabling mixing of said reagents in said central mixing chamber, said central mixing chamber sealed so as to prevent outflow of said mixed reagents.

2. The apparatus as recited in claim 1, wherein a clamp means comprises:

a support plate adjacent said tubular member; and movable bar means positioned to pinch said tubular member against said support plate, whereby operation of said control means enables movement of said movable bar means and a resultant opening of said channel to enable pressured fluid flow.

3. The apparatus as recited in claim 2, wherein each said spring biased means presses said tubular member against said support plate at each said reagent chamber.

4. The apparatus as recited in claim 3, wherein said clamp means comprises:

a shaft slidably mounted in said support plate, said shaft having a latch surface movable therewith, and wherein said control means comprises an electrically movable core, operable in one position to engage said latch surface, said core and latch surface being engagable when said clamp means is moved to apply pinching pressure against tubular member.

5. The apparatus as recited in claim 4, wherein said control means, upon actuation moves said core to disengage it from said latch means and to release said clamp means whereby said pinching pressure is released.

6. An apparatus for mixing fluids comprising:

a plate;

a pair of T-shaped, flexible, tubular members, said T-shaped members having horizontal and central vertical portions, each said tubular member having reagent receiving regions at horizontal extremities of said T-shapes, said central vertical portions extending through openings in said plate and adapted to receive and hold a mixture of reagents from said reagent receiving regions;

adjustable side straps mounted on said plate for sealing extremities of said horizontal portions of said tubular member against fluid flow when adjusted to pinch said portions against said plate;

a pair of clamp means spanning said horizontal portions, one on either side of said vertical portions, said clamp means movable to pinchably seal said tubular members to create chambers for reagents in said horizontal portions, said reagent chambers separated by said central vertical portions;

spring biased bearing means for pressurizing contents of said reagent receiving regions; and control means associated with each said clamp means enabling movement of a said clamp means to a non-pinching position, said bearing means moving under influence of a spring bias to force a reagent in a chamber to move to said central vertical portion.

7. The apparatus as recited in claim 6 wherein said bearing means comprises:

posts adjacent reagent receiving regions in said horizontal portions, said posts fixed to said plate;

a pressure bar associated with each said post, each said bar positioned to span and bear upon corresponding reagent receiving regions in adjacent horizontal portions of said tubular members; and spring means on each said post for biasing said bars against said reagent receiving regions.

8. The apparatus as recited in claim 7 wherein each said clamp means comprises:

a yoke shaft slidable mounted in said plate between adjacent tubular members;

a yoke connected to said yoke shaft and positioned orthogonally to said tubular members, whereby when said yoke shaft is in a lowermost position, said yoke bears upon said tubular members and pinches off their tubular interiors against said plate, to prevent fluid flow therethrough.

9. The apparatus as recited in claim 8 wherein each said yoke shaft includes a latch surface, and wherein said control means comprises:

a pair of solenoids, each solenoid having a movable core, each said core, when engaged with a said latch surface acting to maintain a yoke shaft in its lowermost position, to thereby cause said yoke shaft to perform a pinching action on said tubular members.

10. The apparatus as recited in claim 9 wherein, upon energization, a solenoid is caused to withdraw its respective core from engagement with said latch surface, to release a yoke shaft and enable said yoke to elevate, thereby enabling fluid flow in said tubular member.

11. The apparatus as recited in claim 6 further comprising:

flow control means positioned within said tubular member to cause turbulent fluid flow between said reagent chambers and said central chambers.

12. The apparatus as recited in claim 6 further comprising:

flow control means positioned in a central chamber to separate it into upper and lower mixing chambers, said flow control means including a communicating orifice between said upper and lower mixing chambers to enable limited fluid flow therebetween.

* * * * *

UNITED STATES PATENT AND TRADEMARK OFFICE

CERTIFICATE OF CORRECTION

PATENT NO. : 5,188,455
DATED : February 23, 1993
INVENTOR(S) : Hammerstedt, Roy H.

It is certified that error appears in the above-indentified patent and that said Letters Patent is hereby corrected as shown below:

Column 1, line 3: insert --This invention was made with support from the Government under Case No. HQN-11-065-1CU awarded by the National Aeronautics and Space Administration. The Government has certain rights in the invention.--

Signed and Sealed this
Eleventh Day of February, 1997

Bruce Lehman

*Attest:*

BRUCE LEHMAN

*Attesting Officer*

*Commissioner of Patents and Trademarks*